US006986632B2

(12) United States Patent
Spatafora et al.

(10) Patent No.: US 6,986,632 B2
(45) Date of Patent: Jan. 17, 2006

(54) METHOD AND UNIT FOR FEEDING ELONGATED ELEMENTS

(75) Inventors: Mario Spatafora, Bologna (IT); Luca Borderi, Sasso Marconi (IT)

(73) Assignee: G.D Societa' per Azioni, Bologna (IT)

( * ) Notice: Subject to any disclaimer, the term of this patent is extended or adjusted under 35 U.S.C. 154(b) by 233 days.

(21) Appl. No.: 10/281,084

(22) Filed: Oct. 25, 2002

(65) Prior Publication Data

US 2003/0113195 A1 Jun. 19, 2003

(30) Foreign Application Priority Data

Oct. 31, 2001 (IT) ..... BO2001A0657

(51) Int. Cl.
*B65G 65/23* (2006.01)

(52) U.S. Cl. ..... 414/421; 414/414; 414/810; 198/347.1; 131/909

(58) Field of Classification Search ..... 414/414, 414/419, 420, 421, 810; 198/347.1; 131/282, 131/283, 909
See application file for complete search history.

(56) References Cited

U.S. PATENT DOCUMENTS

| | | | | | |
|---|---|---|---|---|---|
| 3,190,478 | A | * | 6/1965 | Schmermund | 414/414 |
| 3,298,549 | A | * | 1/1967 | Schmermund | 414/414 |
| 3,545,593 | A | | 12/1970 | Wallenborn | 198/53 |
| 3,550,799 | A | * | 12/1970 | Marradi | 414/421 |
| 3,600,873 | A | | 8/1971 | Pirat | 53/35 |
| 3,672,522 | A | * | 6/1972 | Wahle et al. | 414/421 |
| 3,703,242 | A | * | 11/1972 | Marradi | 414/414 |
| 3,854,611 | A | * | 12/1974 | Wahle | 414/414 |
| 3,883,017 | A | * | 5/1975 | Shirai et al. | 414/414 |
| 4,056,206 | A | * | 11/1977 | Bennett | 414/419 |
| 4,303,366 | A | * | 12/1981 | Hinchcliffe et al. | 414/419 |
| 4,319,861 | A | * | 3/1982 | Seragnoli | 414/419 |
| 4,366,895 | A | | 1/1983 | Bennett et al. | 198/347 |
| 4,449,625 | A | * | 5/1984 | Grieben et al. | 198/465.1 |
| 4,482,282 | A | * | 11/1984 | Wildmoser | 414/404 |
| 4,575,301 | A | * | 3/1986 | Lodi et al. | 414/411 |
| 4,696,617 | A | * | 9/1987 | Kumata et al. | 414/422 |
| 4,986,718 | A | * | 1/1991 | Kumata et al. | 414/421 |
| 5,263,805 | A | * | 11/1993 | Brizzi et al. | 414/391 |
| 5,435,688 | A | | 7/1995 | Tokunaga et al. | 414/419 |
| 6,517,306 | B1 | * | 2/2003 | Budny et al. | 414/420 |
| 6,860,697 | B2 | * | 3/2005 | Bradbury et al. | 414/420 |

FOREIGN PATENT DOCUMENTS

| | | | |
|---|---|---|---|
| FR | 2 372 757 | | 12/1977 |
| GB | 2029787 | * | 3/1980 |

* cited by examiner

*Primary Examiner*—James W. Keenan
(74) *Attorney, Agent, or Firm*—Ladas & Parry LLP

(57) ABSTRACT

A method of feeding cigars to a hopper of a wrapping machine, wherein the cigars are housed in bulk and in orderly manner inside containers; each container has a top opening by which to receive and unload the cigars in the aforementioned orderly manner; a full container of cigars is picked up and inverted at the hopper by means of a manipulating device so that the opening faces downwards; and the full container is rested on a supporting surface having a passage smaller than the opening, so as to partly close the opening and provide for controlled unloading of the cigars.

21 Claims, 5 Drawing Sheets

METHOD AND UNIT FOR FEEDING ELONGATED ELEMENTS

The present invention relates to a method of feeding elongated elements.

More specifically, the present invention relates to a method of feeding cigars to a wrapping machine hopper, to which the following description refers purely by way of example.

BACKGROUND OF THE INVENTION

Cigars are normally fed to a wrapping machine hopper in two ways: by connecting the manufacturing machine directly to the wrapping machine by a conveyor conveying the cigars in bulk; or by arranging the cigars coming off the manufacturing machine in orderly manner inside containers, which are then emptied into the wrapping machine hopper.

The first method is suitable for producing large batches of cigars, and binds the output rate of the manufacturing machine to that of the wrapping machine; while the second method is suitable for producing small batches, by the containers being easily stacked in a store and fed to the wrapping machine as required.

An example of feeding of rod-like articles according to the second method is given by U.S. Pat. No. 4,303,366, which discloses an apparatus for unloading rod-like articles from containers; in particular trays containing parallel rod-like articles are unloaded by rotation until the trays are at least partially inverted, the rotation being about an axis parallel to the articles. In one arrangement a pair of tray carriers is rotatable to successively invert a full tray over delivery conveyors and to return an empty tray; one of the conveyors is also rotatable about the same axis. A removable slat retains the articles in the full tray until it is completely inverted. In another arrangement a full tray is received in a bracket in which it is moved to a tilted position for unloading. A pivoted closure member is provided for the open top of the tray and this also serves as a barrier for the unloading articles.

Further examples of feeding of rod-like articles according to the second method are given by U.S. Pat. Nos. 4,366,895, 3,545,593 and 3,600,873.

In the case of the second method, the cigars must be unloaded from the containers into the wrapping machine hopper fairly quickly, but also carefully to avoid disarranging or damaging the cigars in the process.

SUMMARY OF THE INVENTION

It is an object of the present invention to provide a method of feeding elongated elements in accordance with the second method, but which also provides for extremely careful handling of the elongated elements.

According to the present invention, there is provided a method of feeding elongated elements to a hopper of a wrapping machine.

The above method of feeding elongated elements prevents the elongated elements in the container from being unloaded simultaneously in bulk, and so turning axially offset, thus resulting not only in damage to, but also in impaired outfeed of the elements.

In one embodiment, the method provides for varying the position of the passage with respect to the container and the opening; moving the passage with respect to the container ensures all the elongated elements are unloaded from the container.

The present invention also relates to a unit for feeding elongated elements.

According to the present invention, there is provided a unit for feeding elongated elements to a hopper of a wrapping machine.

BRIEF DESCRIPTION OF THE DRAWINGS

A non-limiting embodiment of the present invention will be described by way of example with reference to the accompanying drawings, in which.

DETAILED DESCRIPTION OF THE INVENTION

Figure 1:
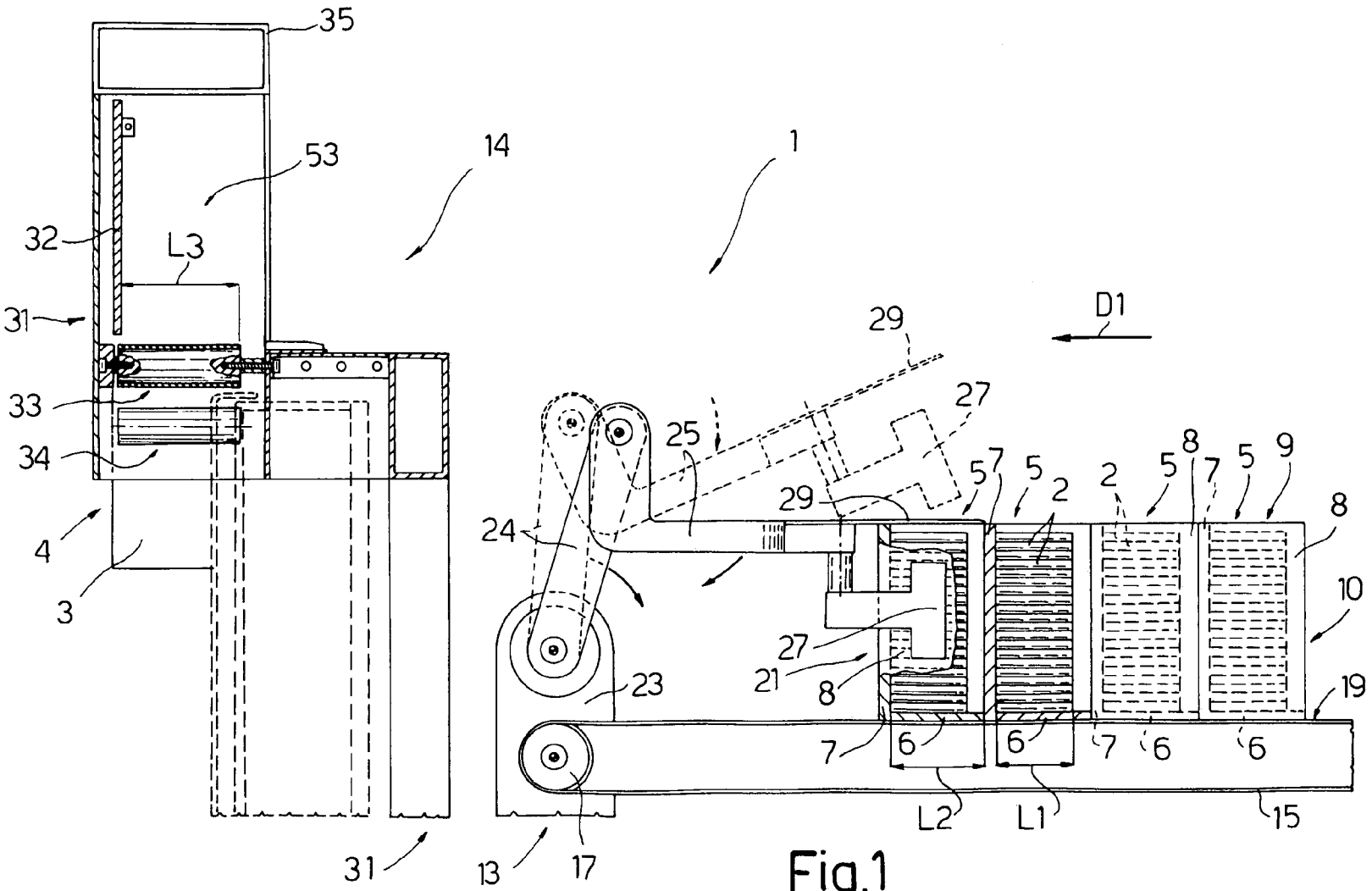
FIG. 1 shows a side view, with parts in section and parts removed for clarity, of a unit for implementing the method according to the present invention and in the course of first operating steps.
Figure 2:
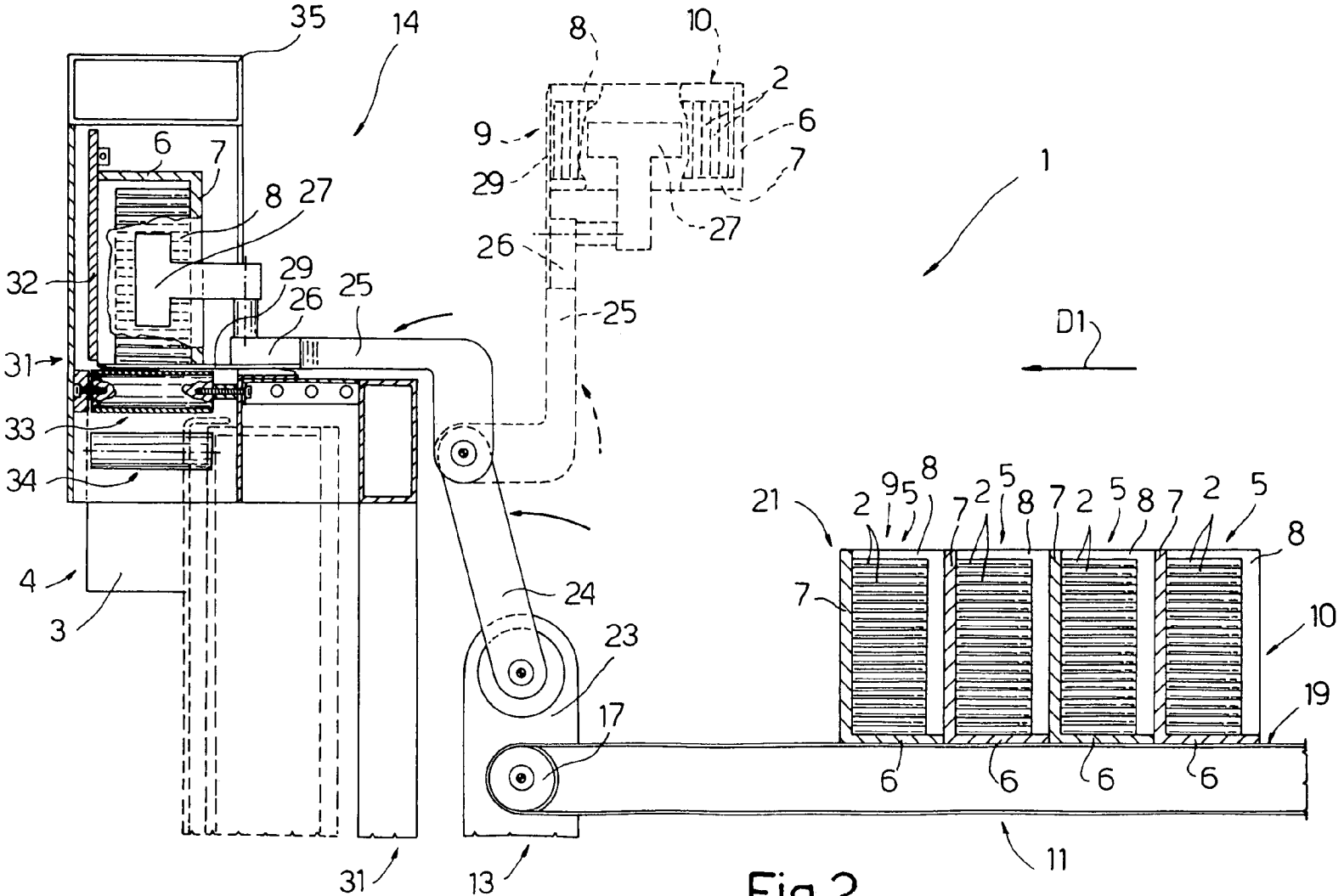
FIG. 2 shows a side view, with parts in section and parts removed for clarity, of the FIG. 1 unit in the course of second operating steps.

Number 1 in FIGS. 1 and 2 indicates as a whole a unit for feeding cigars 2 to a hopper 3 of a wrapping machine 4.

Cigars 2 have a length L1 (FIG. 1) and a width W1 (FIG. 4), and are housed in bulk and in orderly manner, side by side and parallel to one another, inside containers or so-called feedboxes 5. Each container 5 comprises a rectangular bottom wall 6; a rectangular main wall 7 perpendicular to bottom wall 6; and two facing, parallel lateral walls 8 perpendicular to walls 6 and 7. Each container 5 has no top wall and no wall facing main wall 7, and comprises a top opening 9 and a main opening 10. Top opening 9 has a width W2 (FIG. 4) substantially equal to the width of container 5 and greater than length L1; and a length L2 (FIG. 1) slightly greater than length L1 of cigars 2, which rest on bottom wall 6 with the tips resting against main wall 7.

With reference to FIGS. 1 and 2, unit 1 comprises a conveyor 11 for supplying full containers 5; a conveyor 12 (FIG. 3) for removing empty containers 5; a manipulator 13 for manipulating containers 5; and an unloading device 14 for unloading cigars 2 from containers 5.

Figure 3:
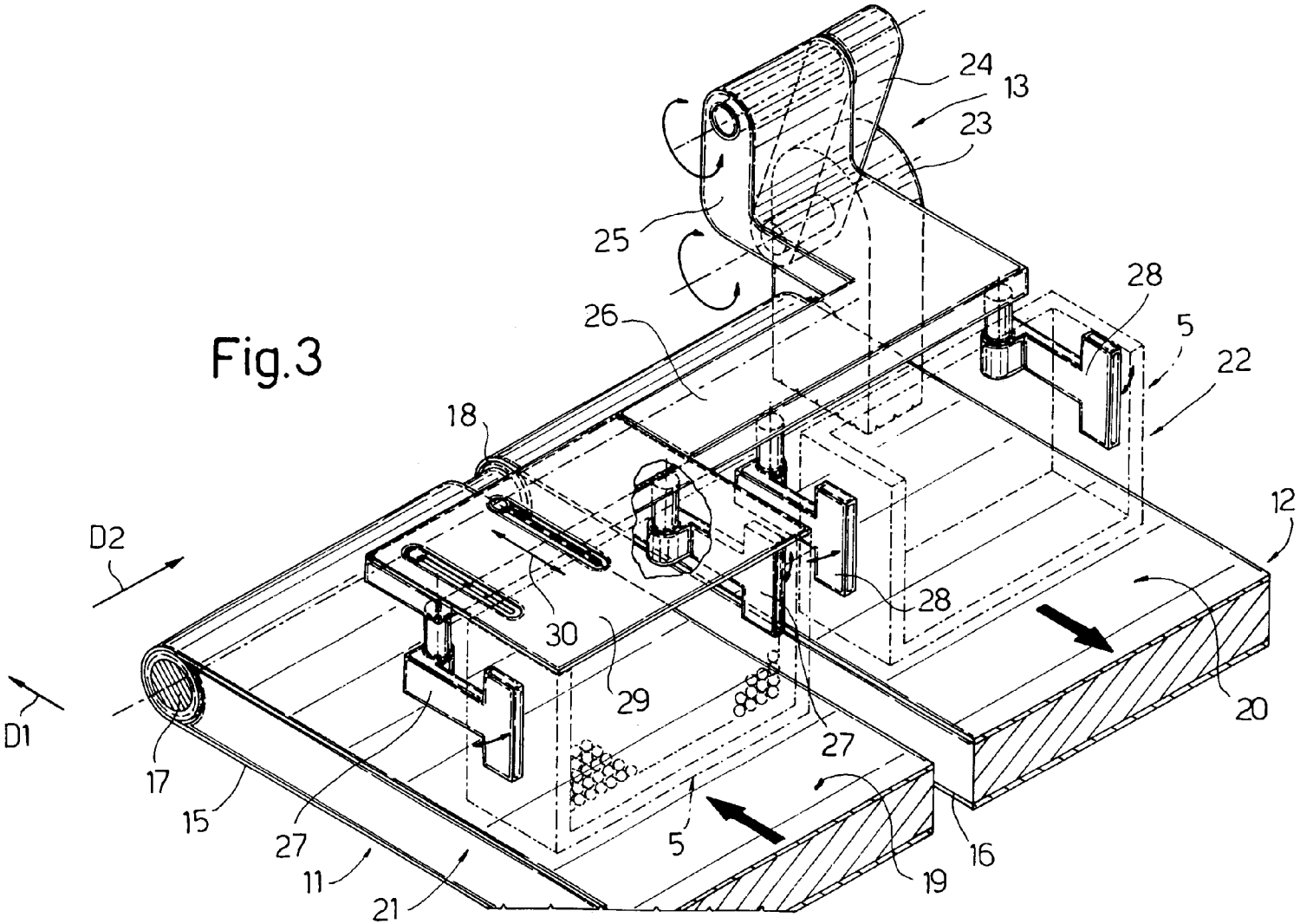
FIG. 3 shows a larger-scale view in perspective, with parts removed for clarity, of a detail of the FIG. 1 unit.

With reference to FIG. 3, conveyors 11 and 12 are parallel, side by side belt conveyors, extend in a direction D1, comprise respective belts 15 and 16 looped about respective pulleys 17 and 18 (only two of which are shown in FIG. 3), and have respective conveying branches 19 and 20 coplanar with each other. Conveyor 11 defines a pickup station 21 for picking up containers 5 and located at pulley 17; and conveyor 12 defines a release station 22 located at pulley 18 and alongside station 21.

With reference to FIGS. 1 to 3, manipulator 13 is located at stations 21 and 22, and comprises a frame 23; an arm 24 hinged to frame 23; an arm 25 hinged to arm 24; and a bar 26 integral with arm 25 and extending in a horizontal direction D2 perpendicular to direction D1. Manipulator 13 also comprises two jaws 27 for picking up containers 5 at pickup station 21, and feeding containers 5 to unloading device 14; two jaws 28 for removing containers 5 from unloading device 14 and releasing them at release station 22; and a cover 29 over jaws 27.

Jaws 27 and 28 are hinged to bar 26 about respective axes perpendicular to direction D2, and grip containers 5 by lateral walls 8; cover 29 is fitted to bar 26, and is adjustable in the directions indicated by arrow 30 to adapt its position to the length L2 of container 5; and manipulator 13 comprises a number of known actuators (not shown) for rotating arms 24 and 25 about axes parallel to direction D2, and jaws 27 and 28 about their respective axes.

With reference to FIGS. 1 and 2, unloading device 14 is located over hopper 3, on the opposite side of manipulator 13 to conveyors 11 and 12, and comprises a frame 31; a vertical plate 32 integral with frame 31; an unloading conveyor 33; and a feed conveyor 34 for feeding hopper 3.

Figure 4:
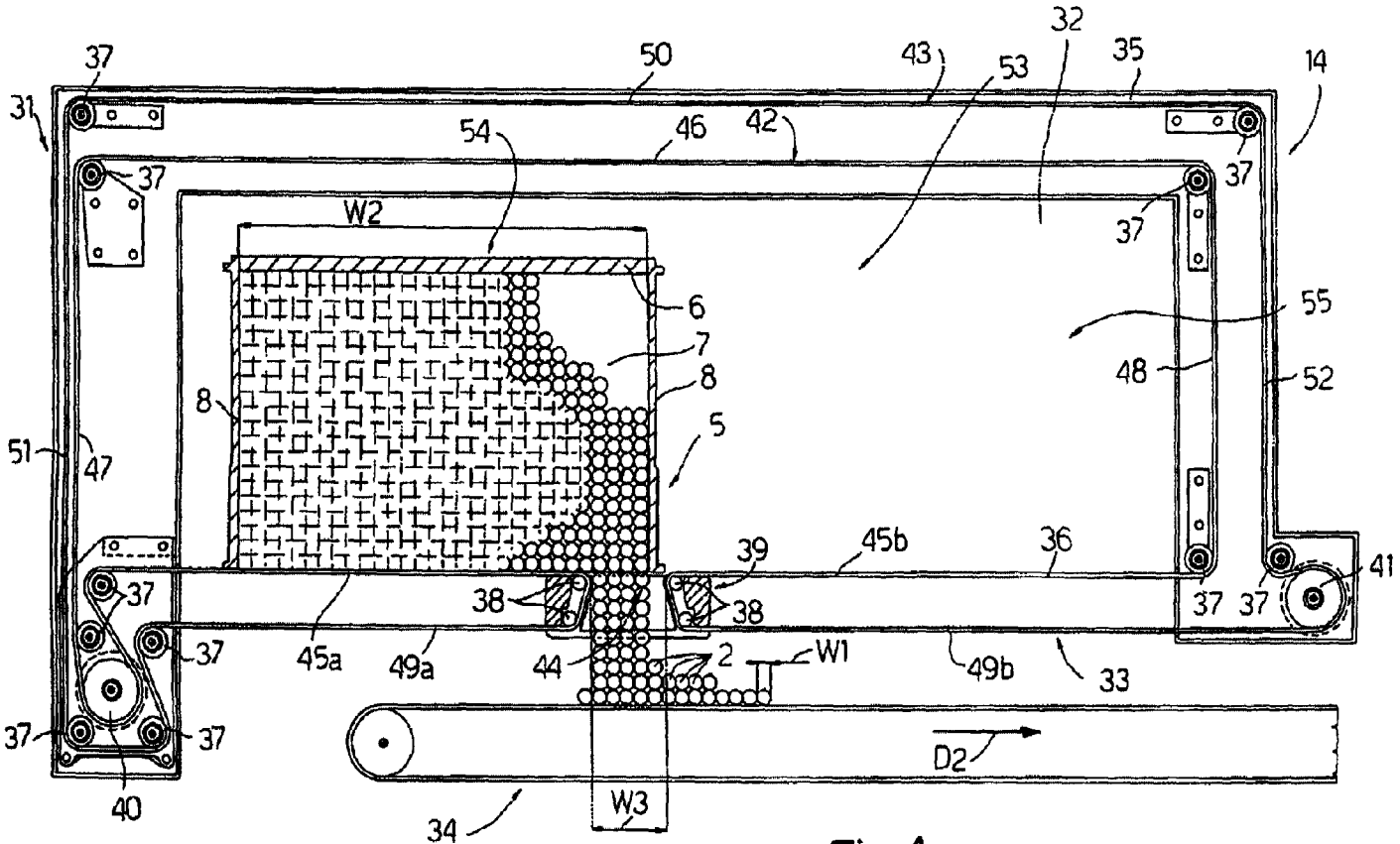
FIG. 4 shows a larger-scale front view, with parts removed for clarity, of a further detail of the FIG. 1 unit in the course of a first unloading step.

With reference to FIG. 4, frame 31 comprises an inverted-U-shaped top portion 35 enclosing plate 32 and conveyor 33, which comprises a belt 36 looped about a number of idle pulleys 37 fixed to portion 35, about four idle pulleys 38 fitted to a movable carriage 39, and about two drive pulleys 40 and 41 fixed to portion 35. Pulleys 37, 38, 40 and 41 rotate about respective axes parallel to direction D1; and carriage 39 is mounted to run inside a guide (not shown) extending in direction D2, and supports two top pulleys 38 separated by a distance W3, and two bottom pulleys 38 separated by a distance greater than distance W3.

Pulleys 37, 38, 40 and 41 are so located that endless belt 36 forms an inner branch 42 and an outer branch 43. In other words, branches 42 and 43 are substantially parallel to each other along an open annular path at pulleys 38, which define a passage 44 of a width equal to distance W3 and smaller than length L1 of the cigars, and of a length L3 (FIG. 1) greater than length L1 of cigars 2.

Inner branch 42 comprises two horizontal, coplanar portions 45*a* and 45*b* separated by passage 44 and defining a supporting surface for containers 5; a portion 46 parallel to portions 45*a* and 45*b*; and two vertical portions 47 and 48. Similarly, outer branch 43 comprises two horizontal portions 49*a* and 49*b* parallel to and facing portions 45*a* and 45*b* respectively; a portion 50 parallel to and facing portion 46; and two vertical portions 51 and 52 parallel to and facing portions 47 and 48 respectively.

Drive pulley 40 engages inner branch 42, and is located between portions 45*a* and 47; and drive pulley 41 engages outer branch 43, and is located between portions 49*b* and 52.

Conveyor 33 and plate 32 define a housing 53 for simultaneously housing two containers 5 located respectively at a hold station 54, where manipulator 13 deposits full containers 5, and at a hold station 55, where manipulator 13 picks up the empty containers 5.

Feed conveyor 34 extends beneath portions 45*a*, 45*b*, 49*a*, and 49*b* to receive cigars 2 from passage 44 and to feed cigars 2 to hopper 3.

In actual use, and with reference to FIG. 1, an orderly succession of containers 5 is fed by conveyor 11 in steps in direction D1 to manipulator 13. Containers 5 are positioned contacting one another, with respective main walls 7 facing manipulator 13, so that cigars 2 are fed parallel to the traveling direction D1 of conveyor 11.

Conveyor 11 is stopped when the first container 5 in the succession reaches pickup station 21. While conveyor 11 is stationary, manipulator 13 picks up the first container 5 by gripping lateral walls 8 of container 5 by means of jaws 27, and positions cover 29 over opening 9. Once container 5 is gripped, arm 24 is rotated anticlockwise into the position shown in FIG. 2, and arm 25 is rotated from the position shown by the dash line to the position shown by the continuous line in FIG. 2, so as to rest cover 29 on the supporting surface defined by portions 45*a* and 45*b* at hold station 54 of containers 5. At this step, in normal operating conditions, an empty container 5 is located at station 55 alongside container 5 at station 54, with jaws 27 on either side of the full container 5, and jaws 28 on either side of the empty container 5; and jaws 27 are opened to release the full container 5, and jaws 28 closed to pick up the empty container 5. Manipulator 13 then withdraws cover 29 from housing 53, together with the empty container 5, which is deposited at release station 22 of conveyor 12 and carried off by conveyor 12. The combined movement of arms 24 and 25 provides for withdrawing cover 29 parallel to direction D1.

With reference to FIG. 2, the full container 5 is rested against vertical plate 32, with opening 10 facing and closed by plate 32.

With reference to FIG. 4, once cover 29 is withdrawn, the full container 5 is positioned partly over portion 45*a* of unloading conveyor 33, and partly over passage 44, through which cigars 2 drop out of container 5 into a pile on conveyor 33, which feeds cigars 2 to hopper 3. The cigars 2 in container 5 drop partly out through passage 44 until a condition of equilibrium, depending on the natural slope angle of cigars 2, is established inside container 5.

Figure 6:
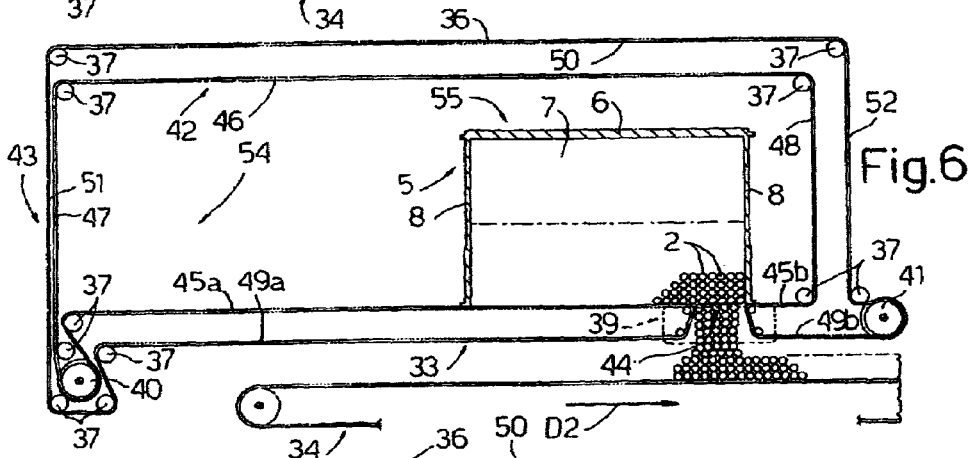
Figure 7:
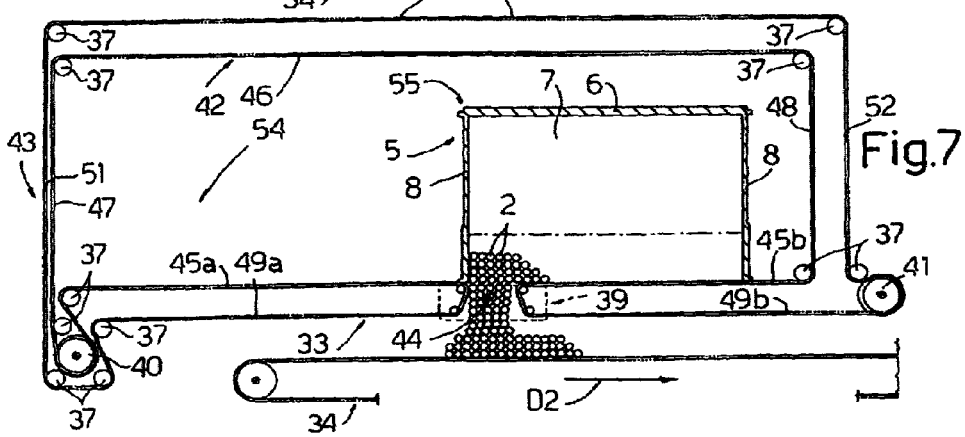

To transfer container 5 from station 54 (FIG. 4) to station 55 (FIGS. 5, 6 and 7), pulley 40 is rotated anticlockwise, while pulley 41 is locked. That is, outer branch 43 is locked, while branch 42 is moved anticlockwise. Pulley 40 exerts pull on portions 47, 46, 48 and 45*b* to move carriage 39 (from left to right in FIG. 4) and so exert pull on portion 45*a* to also move container 5 from left to right in FIG. 4. Since outer branch 43 is locked, portions 45*a* and 45*b*, and obviously container 5, move at twice the speed of carriage 39, so that passage 44 changes position with respect to container 5 to unload further cigars 2 as container 5 is transferred from station 54 to station 55.

Figure 5:
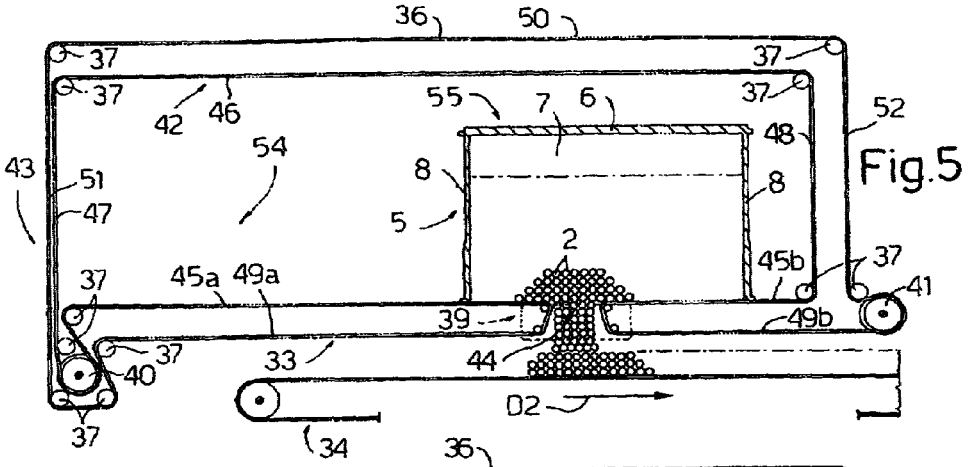
FIGS. 5 to 7 show smaller-scale front views, with parts removed for clarity, of the FIG. 4 detail in the course of further unloading steps.

With reference to FIG. 5, once container 5 is positioned at station 55, pulley 40 is locked to lock inner branch 42, and pulley 41 is rotated anticlockwise to move carriage 39 leftwards (FIG. 7), and then clockwise to move carriage 39 rightwards (FIG. 6) so that passage 44 successively covers the whole of opening 9. Carriage 39 is moved repeatedly to unload all of cigars 2 from container 5. In other words, passage 44 is moved by an amount greater than the width W2 of the container, so as to cover all portions of opening 9 and ensure container 5 is unloaded completely.

During operation of pulley 41, in fact, branches 45*a* and 45*b* are locked and impart no rotary movement to the cigars 2 still inside container 5.

In addition to cigars 2, unit 1 described may also be used for bulk feeding cigarettes or other types of elongated elements.

What is claimed is:

1. A method of feeding elongated elements to a hopper of a wrapping machine; the elongated elements (2) being housed in bulk and in orderly manner inside containers (5); each container (5) comprising a top opening (9) by which to receive and unload said elongated elements (2); the method comprising the step of picking up a full container (5) of elongated elements (2);

feeding the full container (5) to a first hold station (54) at said hopper (3);

overturning the full container (5) at said first hold station (54) by means of a manipulator (13), so that said opening (9) faces downwards;

placing the full container (5) on a supporting surface (45*a*, 45*b*) having a passage (44) smaller than said opening (9), so as to partly close said opening (9) and provide for controlled unloading of said elongated elements (2);

moving said container (5) along said supporting surface (45*a*, 45*b*) from the first hold station (54) to a second hold station (55) during the controlled unloading of said elongated elements (2) from the full container (5) and trough said passage (44); and removing an empty container (5) from the second hold station (54).

2. A method as claimed in claim 1, wherein the position of said passage (44) is varied with respect to said container (5) and said opening (9).

3. A method as claimed in claim 2, wherein said passage (44) is moved along the whole opening (9) of said container (5) by means of an unloading conveyor (33) defining said supporting surface (45*a*, 45*b*) for the full container (5).

4. A method as claimed in claim 2, wherein the full container (5) is moved from the first hold station (54) to the second hold station (55) at a speed greater than the speed of movement of said passage (44).

5. A method as claimed in claim 4, wherein said elongated elements have a first width (W1) and a given first length (L1); said container (5) and said passage (44) having, respectively, a second length (L2) and a third length (L3), both greater than said first length (L1); said opening (9) and said passage (44) having, respectively, a second and a third width (W2, W3); said second width (W2) being greater than the first length (L1); and the third width (W3) being smaller than the first length (L1).

6. A method as claimed in claim 1, wherein a full container (5) is fed to said first hold station (54), and an empty container (5) is removed from said second hold station (54) by means of said manipulator (13); said manipulator (13) comprising two first jaws (27) for gripping the full container (5), and two second jaws (28) for gripping the empty container (5).

7. A method as claimed in claim 6, wherein said opening (9) of the full container (5) is closed by means of a cover (29), fitted to said manipulator (13), as said full container (5) is transferred by means of said manipulator (13).

8. A method as claimed in claim 6, wherein the containers (5) are fed to said manipulator (13) by means of a first conveyor (11), and the empty containers (5) are removed by means of a second conveyor (12).

9. A unit for feeding elongated elements to a hopper of a wrapping machine; the elongated elements (2) being housed in bulk and in orderly manner inside containers (5); each container (5) comprising a top opening (9) by which to receive and unload said elongated elements (2); the unit comprising a manipulator (13) for picking up a full container (5) of elongated elements (2) and overturning the full container (5) at said hopper (3) so that said opening (9) faces downwards, and an unloading device (14), which is located at said hopper (3) and comprises a supporting surface (45*a*, 45*b*) having a passage (44) smaller than said opening (9), so as to partly close said opening (9) and provide for controlled unloading of said elongated elements (2); wherein the unloading device (14) comprises an unloading conveyor (33) for varying the position of said passage (44) with respect to said container (5) and said opening (9);

said unloading conveyor (33) comprising an endless belt (36) defining a first and a second branch (42; 43); and a carriage (39) having transmission pulleys (38), which separate the first branch (42) from the second branch (43), and between two of which said passage (44) is defined said unloading conveyor (33) comprises a first drive pulley (40) engaging said first branch (42) to move the first branch (42) together with said container (5) and said carriage (39);

said unloading conveyor (33) comprises a second drive pulley (41) engaging the second branch (43) to move the second branch (43) and said carriage (39); and said first and second drive pulley (40, 41) can be locked selectively to arrest the first and second branch (42, 43) respectively.

10. A unit as claimed in claim 9, wherein said first branch (42) comprises two portions (45*a*, 45*b*) coplanar with each other and located on opposite sides of said carriage (39); said portions (45*a*, 45*b*) defining said supporting surface.

11. A unit as claimed in claim 10, wherein said carriage (39) is movable in a direction parallel to said portions (45*a*, 45*b*).

12. A unit as claimed in claim 9, wherein said unloading device (14) comprises a first and a second hold station (54, 55) for holding said containers (5) and located along said portions (45*a*, 45*b*) of the first branch (42); displacement of the first branch (42) of the belt (36) transferring a container (5) from the first hold station (54) to the second hold station (55).

13. A unit as claimed in claim 12, wherein said manipulator (13) comprises two first jaws (27) for feeding the full container (5) to the first hold station (54); and two second jaws (28) for removing an empty container (5) from the second hold station (55).

14. A unit as claimed in claim 13, wherein said manipulator (13) comprises a cover (29) for closing the opening (9) of said full container (5) as said full container (5) is transferred.

15. A unit as claimed in claim 13, further comprising a first conveyor (11) for feeding full containers (5) to said manipulator (13); and a second conveyor (12) for removing empty containers (5).

16. A unit as claimed in claim 15, wherein said first and said second conveyors (11, 12) are parallel and located side by side.

17. A unit as claimed in claim 15, wherein said first and said second conveyors (11, 12) comprise respective operating branches (19, 20) coplanar with each other.

18. A unit as claimed in claim 15, further comprising a third conveyor (34) located beneath said supporting surface (45*a*, 45*b*) to feed said elongated elements (2) in bulk to said hopper (3).

19. A unit as claimed in claim 9, further comprising first conveying means (11) for feeding full containers (5) of elongated elements (2) successively to the hopper (3), and second conveying means (12) for removing empty containers (5) from the hopper (3); said manipulator (13) comprising first gripping and transporting means (27) for gripping and transporting full containers (5), second gripping and transporting means (28) for gripping and transporting empty containers (5), and an articulated system (23, 24, 25, 26) for supporting and moving said first and second gripping and transporting means (27, 28); said articulated system (23, 24, 25, 26) being movable, in a forward and a return stroke respectively, between a first position, in which the first gripping and transporting means (27) pick up a full container (5) off said first conveying means (11), and the second gripping and transporting means (28) release an empty container (5) onto said second conveying means (12), and a second position, in which the first gripping and transporting means (27) release a full container (5), upside down, over the hopper (3), and the second gripping and transporting means (28) pick up an empty container (5) from the hopper (3).

20. A unit as claimed in claim 19, wherein said first and second conveying means (11, 12) are parallel and located side by side, and comprise respective operating branches (19, 20) coplanar with each other.

21. A unit for feeding elongated elements to a hopper of a wrapping machine; the elongated elements (2) being housed in bulk and in orderly manner inside containers (5); the unit (1) comprising first conveying means (11) for feeding full containers (5) of elongated elements (2) successively to the hopper (3), a manipulator (13) for successively picking up full containers (5) off said first conveying means (11) and inverting the full containers (5) over said hopper (3), and second conveying means (12) for removing empty containers (5) from the hopper (3); said manipulator (13) comprising first gripping and transporting means (27) for gripping and transporting full containers (5), second gripping and transporting means (28) for gripping and transporting empty containers (5), and an articulated system (23, 24, 25, 26) for supporting and moving said first and second gripping and transporting means (27, 28); said articulated system (23, 24, 25, 26) being movable, in a forward and a return stroke respectively, between a first position, in which the first gripping and transporting means (27) pick up a full container (5) off said first conveying means (11), and the second gripping and transporting means (28) release an empty container (5) onto said second conveying means (12), and a second position, in which the first gripping and transporting means (27) release a full container (5), upside down, over the hopper (3), and the second gripping and transporting means (28) pick up an empty container (5) from the hopper (3); said manipulator (13) comprising a frame (23); a first arm (24) hinged to the frame (23); a second arm (25) hinged to the first arm (24); and a bar (26) integral with the second arm (25); said first and second gripping and transporting means (27, 28) being hinged to said bar (26).

* * * * *